US005383417A

United States Patent [19]

Norrid

[11] Patent Number: 5,383,417

[45] Date of Patent: Jan. 24, 1995

[54] NEEDLE THREAD STITCH FORMATION MONITOR

[76] Inventor: Paul E. Norrid, 317 St. Andrew's Dr., Franklin, Tenn. 37064

[21] Appl. No.: 197,618

[22] Filed: Feb. 17, 1994

Related U.S. Application Data

[63] Continuation-in-part of Ser. No. 966,386, Oct. 26, 1992, abandoned.

[51] Int. Cl.[6] ..... D05B 51/00

[52] U.S. Cl. ..... 112/278

[58] Field of Search ..... 112/273, 278, 80.18

[56] References Cited

U.S. PATENT DOCUMENTS

| | | | |
|---|---|---|---|
| 3,425,375 | 2/1969 | Jacobs et al. | 112/278 |
| 3,587,497 | 6/1971 | Beazley | 112/278 |
| 4,102,283 | 7/1978 | Rockerath et al. | 112/278 X |
| 4,426,948 | 1/1984 | Olasz et al. | 112/278 X |
| 4,438,718 | 3/1984 | Hanyu | 112/121.11 X |
| 4,602,582 | 7/1986 | Rawson | 112/273 X |
| 4,735,161 | 4/1988 | Brocklehurst | 112/273 |
| 4,754,722 | 7/1988 | Rohr et al. | 112/278 |
| 4,841,890 | 6/1989 | Tancs | 112/278 X |
| 4,939,159 | 7/1990 | Shibata | 112/278 X |

*Primary Examiner*—Clifford D. Crowder
*Assistant Examiner*—Paul C. Lewis
*Attorney, Agent, or Firm*—Charles A. Phillips

[57] ABSTRACT

This invention relates to a method and apparatus for instantaneously monitoring the presence of properly and improperly formed needle thread stitches for all sewing machines with one or more needles at all operating speeds. An electronic control circuit connected to a high-speed synchronizer sensor and a high-speed thread sensor is provided which yields an instantaneous output of a desired duration when improper stitch formation occurs. The output from the electronic control circuit may be used to alert sewing machine operators in various ways of defective needle thread stitches.

13 Claims, 15 Drawing Sheets

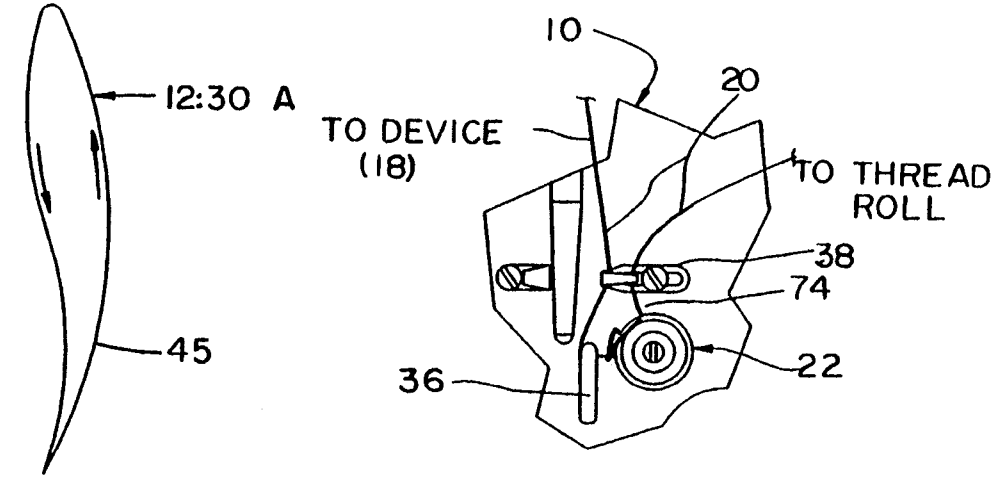
FIG 13c
FIG 13b
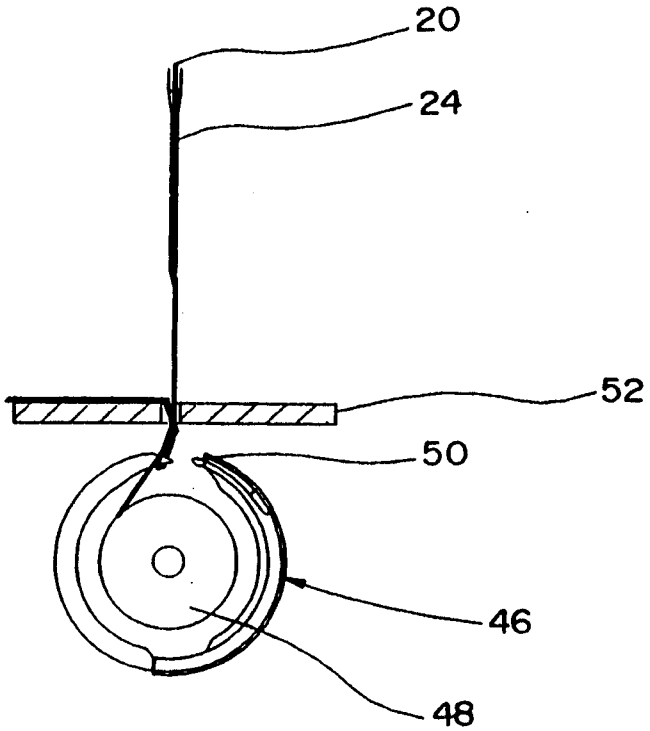
FIG 13a

NEEDLE THREAD STITCH FORMATION MONITOR

CROSS REFERENCE OF RELATED APPLICATION

This is a continuation-in-part of U.S. patent application Ser. No. 07/966,386, filed on Oct. 26, 1992 now abandoned.

FIELD OF THE INVENTION

This application relates generally to sewing machines and more particularly to a method and apparatus for instantaneously monitoring the presence or absence of proper stitch formation of needle threads of sewing machines.

BACKGROUND OF THE INVENTION

Proper needle thread stitch formation is a necessity in generating high-quality sewn products. Improper needle thread stitch formation diminishes the durability and functionality of a sewn seam. Improper needle thread stitch formation is the result of skipped stitches, thread breaks, absence of needle threads, needle breaks, and unpicked-up needle thread.

Sewn product manufacturers pay high costs to sample in-process sewn products and to inspect finished products for needle thread stitch formation defects. These defective stitches must be repaired, if detected before the products are shipped, to provide first-quality products to customers. The whole process of detecting and correcting these defective stitches contributes to a loss of productivity. A reliable, low maintenance, low cost apparatus and method for detecting improper needle thread stitch formation on single and multiple needle sewing machines at all stitch formation rates has not been provided to the sewn products industry.

The prior art abounds with various types of sewing machine monitoring apparatuses. Such monitoring apparatuses typically include mechanisms for stopping a sewing machine, or at least providing a warning signal, when thread breakage or other disturbance of the feed of the thread is detected.

U.S. Pat. No. 4,841,890, issued on Jun. 27, 1989, to Tancs, entitled "Thread Break Indicating Device For Sewing Machines Using a Photoamplifier," monitors the influence of unbroken sewing thread on a light beam during sewing machine operation to detect a needle thread break. The device detects thread breaks and has no capacity to reliably detect proper stitch formation. This deficiency is a result of thread movement of unbroken thread in a sewing machine even when stitch formation does not occur. The device has no capacity to detect thread movement at a particular time during the stitch formation cycle.

U.S. Pat. No. 3,587,497, issued on Jun. 28, 1971, to Beazley, entitled "Thread Breakage Detector," discloses apparatus which monitors check spring contact with a fixed contact block to detect a needle thread break. This apparatus group detects thread breaks and has no capacity to reliably detect proper stitch formation. This deficiency is a result of thread movement of unbroken thread in a sewing machine cycle causing check spring movement when stitch formation does not occur. The device has no capacity to detect thread movement at a particular time during the stitch formation cycle and does not allow for equipment adjustments to expected extremes for all applications of sewing. This adjustment limitation is a result of the fixed block sensor positioning. This device is limited to detecting needle thread breaks on machines producing federal stitch standard 301 (lock stitch) type stitches.

U.S. Pat. No. 4,429,651, issued on Feb. 7, 1984, and entitled "Device For Detecting Absence of a Thread in a Sewing Machine," discloses a device which detects the absence of needle thread or bobbin thread in a sewing machine. The device detects the absence of thread and includes a piezoelectric element placed under the throat plate of the sewing machine. This device depends on high cost, high maintenance piezoelectric sensor technology with inherent, highly sensitive calibration requirements. This device is limited to a machine with unencumbered space to permit attachment of a piezoelectric sensor under the throat plate of the sewing machine. This monitor is limited to a portion of machines capable of sewing federal stitch standard type 301 stitches.

U.S. Pat. No. 4,754,722, issued July 1988 to Rohr et al., for "Thread Break Detector For a Sewing Machine," discloses apparatus including a sensor which detects for thread breaks by monitoring for the absence of sewing thread between two thread guides. The uppermost thread guide is secured to a stationary support, and the lowermost thread guide is secured to the needle bar (needle holer) for vertical movement therewith, and the sewing thread is threaded through these guides and the needle eye. This apparatus requires that existing machines be modified to receive these two guides. The needle bar must be substantially modified to receive the lower guide. Additionally, the addition of the movable guide forces the thread to deviate from a normal single line path during proper machine operation to a plurality of paths that are within a specific range. The apparatus of the present invention does not require the addition of guide assemblies to existing machines, and, particularly, the present invention does not require that the needle bar be modified to receive a guide assembly which must be vertically movable with the needle.

U.S. Pat. No. 4,938,159, issued Jul. 3, 1990, to Yoshio Shibata for "Thread Detecting Apparatus in a Sewing Machine," discloses apparatus for detecting needle thread breaks. The Shibata apparatus includes a first AND gate which receives signals from a timing signal generator means which includes a detecting member on the main drive shaft of the machine, a proximity sensor which utilizes magnetism or electrostatic capacity, and a first gate forming circuit. The proximity sensor senses every time the detection member is rotated one complete rotation. A thread detecting sensor is provided for detecting the end of the thread or thread break (absence of thread) and for transmitting an electrical indication thereof to a second AND gate circuit. A comparator circuit must be provided to compare the two signals and provide a comparator generated signal in response to signals from both AND gates, and, if the comparator generated signal exceeds a reference value, the machine operation may be terminated. It should be noted that the thread sensor circuit of Shibata is dependent on the use of an electrically charged thread engages the sensor element which is mounted in the very confined space beneath the throat plate.

Each of the above patents are directed to apparatuses which are designed to monitor the needle thread for needle thread breakage only. Thread breakage typically occurs for the following reasons:

1. Misaligned offwinding from the thread package.
2. Trapping at the thread package base.
3. Thread trapped at thread guide.
4. Snarling before tension disc.
5. Excessive tension.
6. Broken check spring.
7. Sharp edges on throat plate, hook point, needle guard, bobbin case, needle groove, or eye.
8. Thread fraying at needle.
9. Excessive needle heat, groove, or eye blocked with melted fabric.
10. Hook overheating.
11. Poor quality thread.

U.S. Pat. No. 4,602,582, issued on Jul. 29, 1986, to James W. Rawson for "Monitoring Looper Thread Feed Monitoring Device in a Sewing Machine," is directed to apparatus for monitoring the looper thread instead of needle thread. The apparatus includes a source of light which is conveyed into the thread feed region of the sewing machine by fiber optics. Light receiving means is provided beneath the throat plate to receive the light and produce a monitor signal representative of the received light. A timing means is provided which is responsive to the monitor signal to produce a timing window during which a signal is present if the looper thread is being correctly fed to the sewing machine. The apparatus requires that the end of the fiber optic be in the confined space beneath the throat plate and that the light receiving means also be positioned in this confined area which is subjected to the gathering of dust and, particularly, lint from the sewn material. The presence of such dust and lint can cause the light to be obstructed in the looper area and is, therefore, susceptible to causing the light receiving means to provide false readings. The device of the patent to Rawson monitors the looper thread and not the needle thread, as does the device of the present invention. Some causes of looper thread abnormalities are as follows:

1. Badly worn thread on the bobbin.
2. Tension too tight or bobbin overrunning.
3. Sharp edges on bobbin case or spring or looper eyelet.
4. Bobbin case not fitting correctly.

A sewing machine typically includes a needle which receives thread through its eye from a source of thread which may be mounted on the body of the sewing machine or remotely therefrom. The thread generally follows a path through various thread guides on the machine, through a thread tensioning device, a thread take-up device, and then through other guide means mounted above the needle. The thread is then directed through the eye of the needle. The take-up device pulls the thread tight between the needle and the thread tensioning device.

Such sewing machines typically include a needle thread gathering cycle and a stitch formation cycle. During the thread gathering cycle, the needle gathers thread for use during the stitch formation cycle. During the cycle of stitch formation, needle thread forms a loop at the eye of the needle, and needle thread is caught and the loop is enlarged by a needle thread loop handling device such as a looper, a bobbin hook assembly, or a spreader mounted beneath the throat plate needle hole if a stitch is properly formed. During this stitch formation cycle, a portion of the cycle contains this loop enlargement and the thread above the needle in the sewing machine will react in a predictable pattern between the tension device (typically mounted on the machine body above the needle and through which the thread is threaded) and the needle. If the stitch is being formed properly, the thread will move in a predetermined path between the tension device and the needle. In this predetermined path, the thread assumes a position which places it in registry with a detector mounted on the machine between the take-up device and the needle.

On some sewing machines (such as 301 stitch type machines), the tensioning device includes a check spring assembly having a pivoted arm provided with an eyelet through which the thread is threaded. The thread is then directed through the take-up device prior to being directed through the needle eye. The pivotally mounted arm is pivoted as a result of the needle moving the tensioned thread through the eyelet on an arm of the check spring. Pivotal movement (or non-movement) of the arm can be detected by sensors to generate electrical signals which indicate proper (or improper) arm positions. The arm position is caused to change in response to non-linear (transverse) positioned changes in the thread.

It is to be understood that during the stitch formation cycle, if the thread loop is not "caught" by the hook assembly (or looper) mounted beneath the throat plate, improper thread positioning will occur and be sensed by the sensors discussed above.

It is to be further understood that the thread monitoring system of the present invention monitors the needle thread (not the looper thread) to detect if there is improper conditions at the needle thread loop handling device (looper, bobbin, or spreader, etc.) which would cause a skipped stitch condition. Such skipped stitches typically occur as a result of the following abnormalities:

1. Failure of hook, looper, or needle to enter thread loops at the correct time.
2. Thread loop failure due to incorrect needle size/style for thread size/type.
3. Thread loop failure due to incorrect setting of thread control mechanism causing thread loop starvation.
4. Flagging of fabric due to poor presser foot control or too large a throat plate hole.
5. Needle deflections or bent needle.
6. Incorrect sewing tension in the needle or underthreads.
7. Poor thread loop formation.

The monitoring system of the present invention will provide a warning or will shut down machine operations if a skipped stitch attributable to any of the above-enumerated abnormalities occur.

Accordingly, it is an object of the present invention to provide a method and apparatus for detecting improperly formed needle thread stitches.

It is another object of the present invention to provide a method and apparatus for detecting the presence of such improperly formed needle thread stitches on all type stitch formations, including at least U.S. standard types 101 (chain stitch), 301 (lock stitch), and 401 (double lock chain stitch).

In accomplishing the recited objects, the needle thread stitch formation monitor of the present invention includes a high-speed synchronizer sensor attached to the body of the sewing machine for detecting a sensing medium provided on the main shaft when the thread take-up mechanism of the machine is in the particular portion of the revolution of the shaft of the machine during a stitch formation cycle. In one embodiment of the present invention, the needle thread stitch formation monitor includes a high-speed thread sensor which is actuated by the thread during the stitch formation cycle to provide an output indicative of proper or improper thread position relative to the thread sensor. The thread sensor is a light emitter and light detector assembly positioned between the tension device and the needle, for detecting the presence of needle thread at a particular position between the tension device and the needle on all type stitch formations. In another embodiment of the present invention, the movement of the tension spring of the check spring device, such as is provided on 301 stitch type machines, for example, is detected by a proximity sensor. The sensor is actuated to produce a predetermined output as a result of the thread displacing (or not displacing) an arm of the check spring device during the stitch formation cycle. In each of the above embodiments, the relative timing of the signals from the high-speed thread sensors during the cycle is established by a control circuit including an AND gate which compares signals from the high-speed synchronizer sensor and the high-speed thread sensors. The control circuit determines when a stitch is being properly or improperly formed. When an improperly formed stitch is detected, the control circuit provides a relay output which is used to activate other devices to stop the machine, delay the cycle of the machine, count the occurrences of improperly formed stitches, and alert a sewing machine operator through various means of the absence of a properly formed stitch.

Mounting the high-speed needle thread detecting sensor on the body of the sewing machine between the take-up device and the needle provides a capability for more than one needle tread monitoring sensor per machine to thus allow multiple needle thread monitoring on one machine, if desired. The position of the sensor above the needle of the sewing machine allows the use of optic sensing mechanisms without a loss of function due to lint produced under the throat plate.

FIGS. *7a*, *7b*, *7c*–15*a*, 15*b*, 15*c* illustrate various positions of the take-up eyelet, the rotary hook, and the check spring during the stitch formation cycle of the machine.

DESCRIPTION OF THE PREFERRED EMBODIMENT

Figure 1:
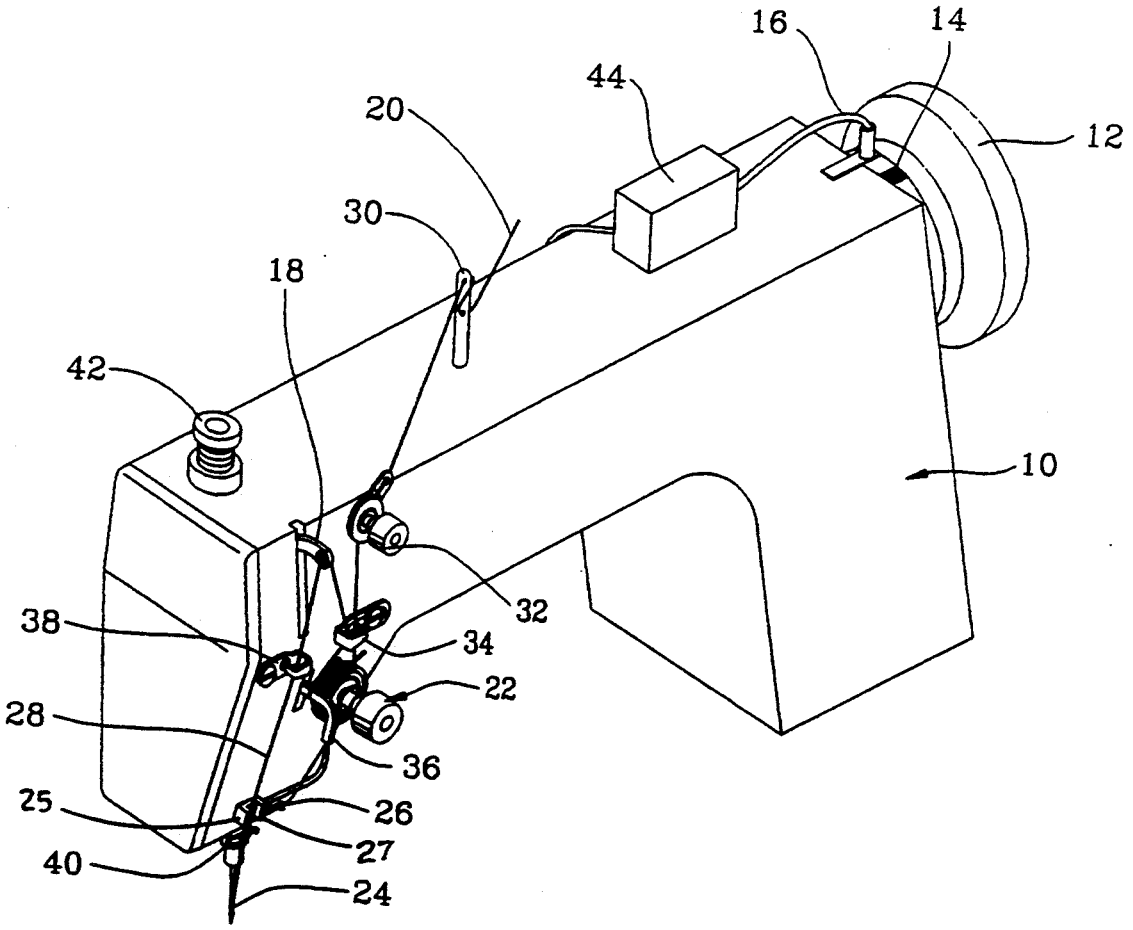
FIG. 1 is a perspective view of a sewing machine having the needle thread stitch thread formation monitor and synchronizing means attached thereto. The figure shows a high-speed thread sensor mounted between the thread take-up device and the needle. The figure also illustrates the electronic control box which houses the electronic circuitry as used in the present invention.

Referring to FIG. 1, the needle thread stitch formation monitor of the present invention is shown to include a sewing machine 10 provided with a hand wheel 12 having a sensing medium 14 thereon. A high-speed synchronizer sensor 16 is attached to sewing machine 10 and is positioned to sense a sensing medium 14 on hand wheel 12. (Such sensors 16 are well known in the art. One such sensor is manufactured by Bluff City Electronics, Nashville, Tenn., Model No. FYEB2K62.) The sensing medium 14 may be a ferrous metal of predetermined dimensions. Sensing occurs when a take-up device 18, mounted on machine 10, is in a predetermined position, at which good position thread 20 is sufficiently tensioned between the take-up device 18 and needle 24 so that the proper stitch formation may occur. A check spring device 22 is mounted on the body of machine 10 to receive and guide thread 20 to the needle as is well known in the art. A high-speed thread sensor 26 is mounted on the body of machine 10 to detect good thread position at 28 (between take-up device 18 and needle 24) when a needle thread stitch is being properly formed. Machine 10 further includes an upper thread guide 30, knife tension device 32, first intermediate thread guide 34, a thread take-up post 36, a second intermediate thread guide 38, a lower thread guide 40, a presser foot tension screw 42, and a control box 44 (which houses the electronic circuitry).

In order to provide a clear description of when thread proper or improper thread position occurs and is sensed in accordance to the present invention during machine operation, attention is directed to FIGS. 6–15 which describe a typical operation required in the formation of a 301 stitch.

Figure 6:
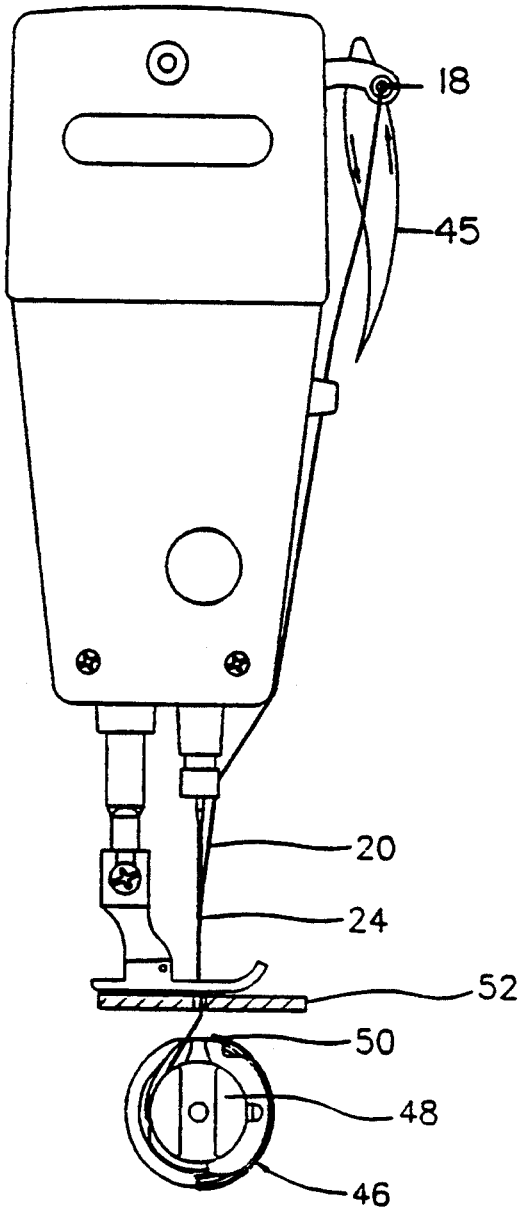
FIG. 6 is a partially broken-away end elevational view of a sewing machine and illustrates a rotary hook assembly mounted below the throat plate of the machine. The elliptical path (take-up ellipse) that the eyelet of the take-up device forms is shown relative to the take-up device.

The operational relationship of the components of a sewing machine when used in forming a 301 stitch is illustrated in FIGS. 6–15*c*. As seen in FIG. 6, the eyelet of take-up device 18 on a lock stitch machine does not move up and down in a straight line, but actually travels in an ellipse (indicated by the numeral 45 and superimposed over device 18) as shown in the upper right corner of FIG. 6. The ellipse pattern is caused by the linkage (not shown) of the take-up 18. An ellipse travel rather than a straight up-and-down movement is necessary in order to allow the take-up device 18 to deliver thread more slowly to a hook assembly 46, mounted below the throat plate 52, on the down stroke and actually travel faster on the upstroke as it takes the needle-loop out of the hook assembly, as will be seen later. While the check spring action does not show in FIG. 6, it is shown in subsequent views.

In the sewing area (FIG. 6) the throat plate 52 has been cut away to allow a clear view of the action of the bobbin thread and the needle thread as it is handled by the rotary hook assembly 46. The bobbin 48 is housed in the hook assembly 46, as is well known in the art.

In the views that follow (FIGS. 7–15), only the thread handling revolution of the hook assembly 46 is shown and not the revolution that occurs while the machine is feeding. In these views, the front view of the hook is referred to as the face of a clock, indicating the hook point position is 12:00, 6:00, etc. The arrow or reference point on the take-up ellipse indicates its position in relation to the hook point 50 of hook assembly 46.

Figure 7A:
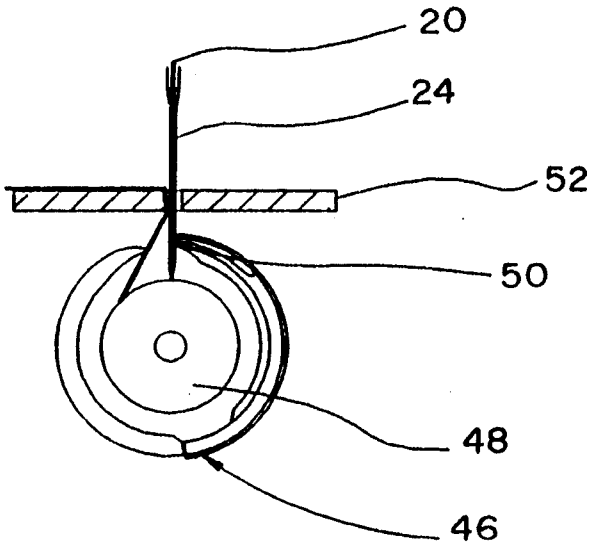
Figure 7B:
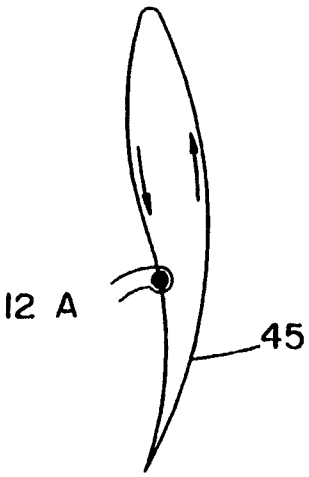
Figure 7C:
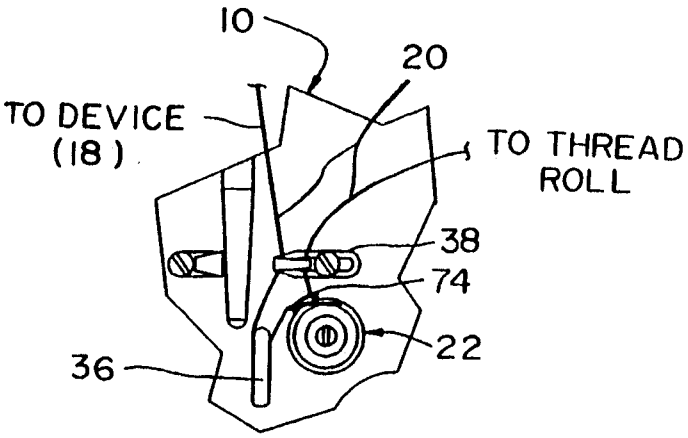

FIGS. 7*a*, 7*b*, and 7*c* illustrate the relative, simultaneous positions, respectively, of the needle and hook assembly, take-up eyelet, and check spring when a hook point 50 of assembly 46 (FIG. 7*a*) is at 12:00 (loop taking position). In this position, the needle has started to rise, throwing out a loop which the tip of the hook point 50 is just entering.

The take-up (eyelet) is descending and is at this 12:00A position in relation to the hook point 50 position. The needle thread is loose at this point in the stitch forming cycle, since the take-up is giving thread to the hook. The check spring 22 (FIG. 7*c*) is completely relaxed since there is no tension on the needle thread.

Figure 8C:
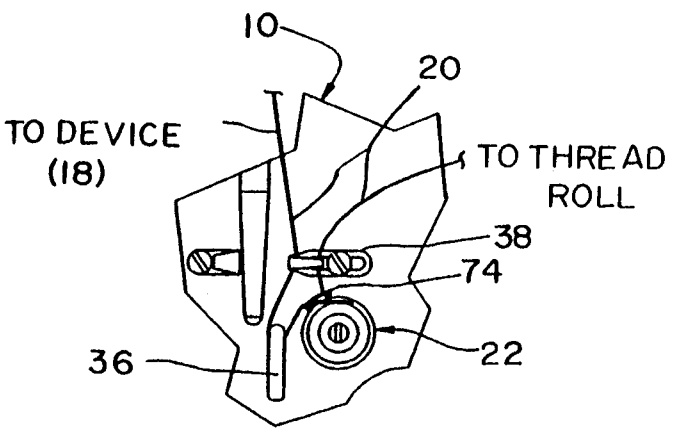
Figure 8B:
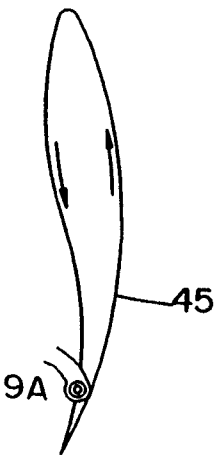
Figure 8A:
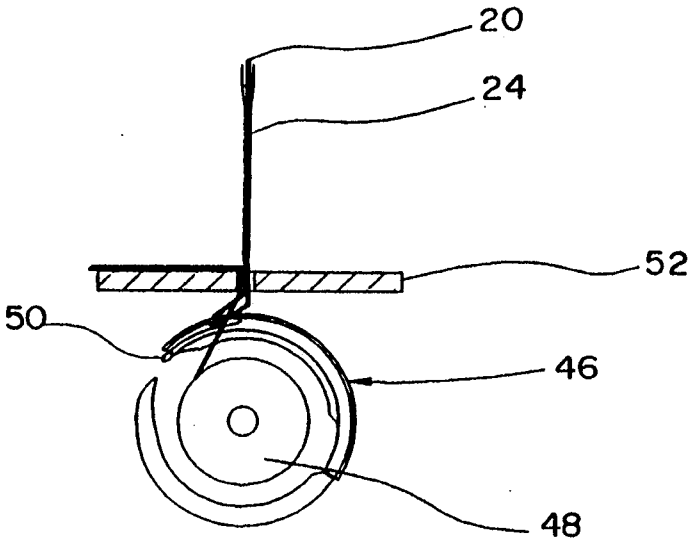

In FIG. 8*a* (needle and hook point), FIG. 8*b* (ellipse), and FIG. 8*c* (check spring) the hook point 50 is at 9:00. The needle is rising almost out of the throat plate (FIG. 8*a*). The needle loop has drawn back over the hook point 50. The upper side of the needle thread loop passes across the hook point 50. This strand of the needle thread is connected to the previous stitch in the material. The underside of the needle loop passes under the hook point 50. The take-up is descending and allows the needle thread to become very slack. Again, this slack is to allow the hook of hook assembly 46 to draw enough thread to make its loop around the bobbin case holder as we continue in the stitch forming cycle. The check spring (FIG. 8*c*) is still inactive.

Figure 9C:
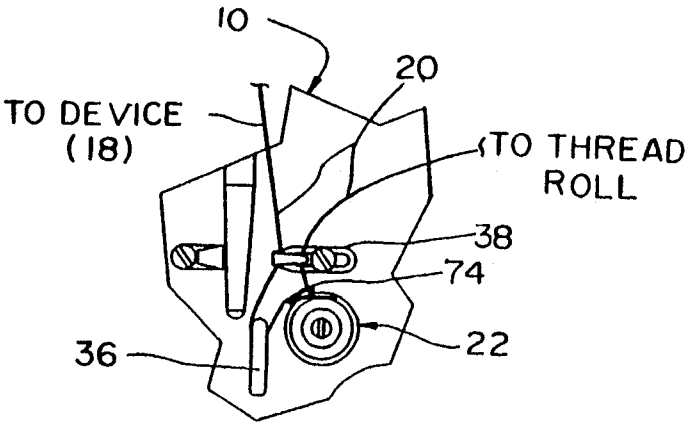
Figure 9B:
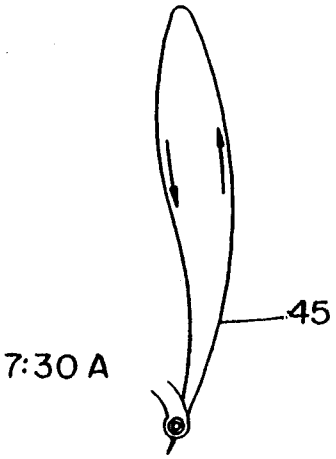
Figure 9A:
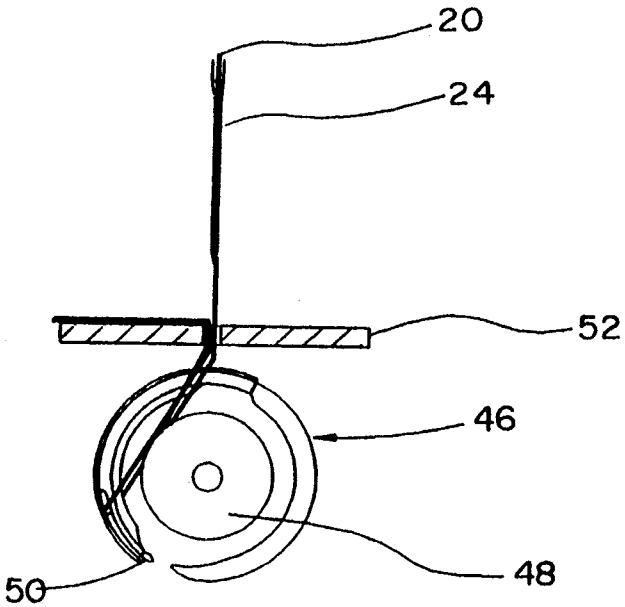

In FIGS. 9*a*, 9*b*, and 9*c*, the hook point 50 is at 7:30. The slack thread delivered by the take-up is being used by the downward movement of the hook point. The bottom side of the needle loop is starting to be drawn around the bobbin case holder by the movement of the hook point 50. The needle is rising and is well out of the throat plate. The take-up is still descending at 7:30A. The check spring (FIG. 9*c*) is still inactive.

Figure 10C:
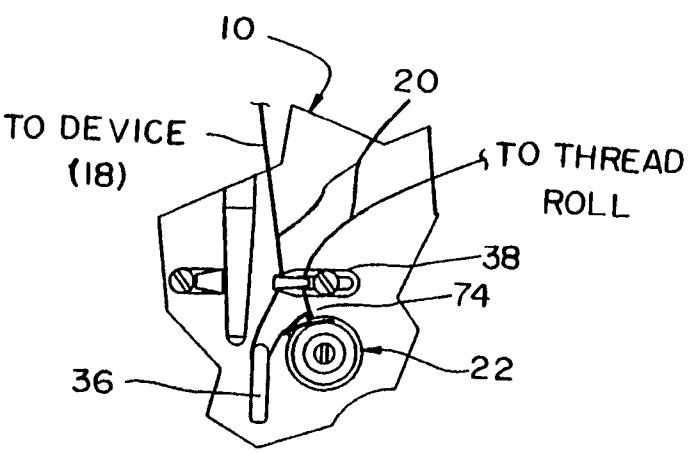
Figure 10B:
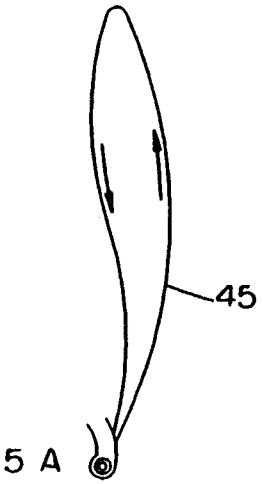
Figure 10A:
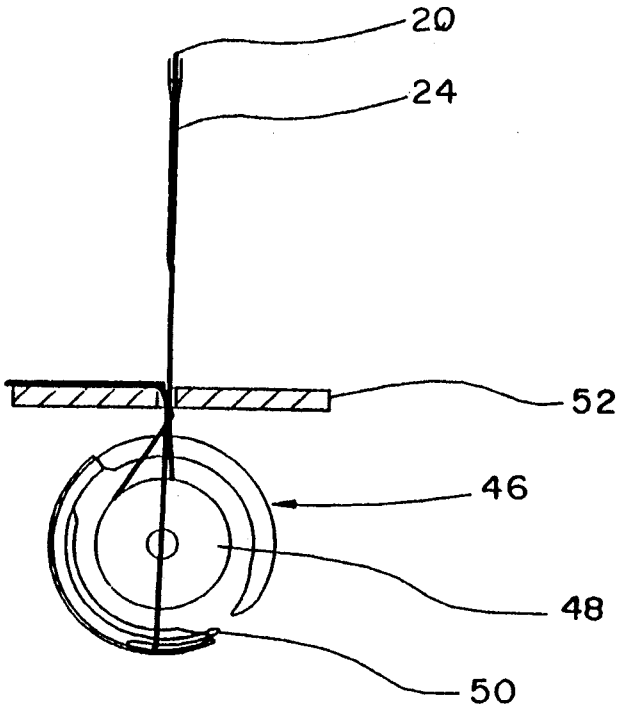

In FIGS. 10*a*, 10*b*, and 10*c*, the hook point is at 5:00. The front side of the needle loop has been drawn down to the 6:00 position by the thread carrying notch (not shown) behind the hook point 50. At the same time, the top front side of the needle loop is now behind the bobbin case holder. One strand of the needle loop is now behind the bobbin thread. The needle is still on its upward travel. The take-up is at the 5:00A position in relation to the hook point, and this is the bottom of the take-up travel. The take-up will start to rise at this point. All of the needle thread slack is gone from the system, and the thread sensor is providing a HIGH output. The check spring should just begin to engage the needle thread at this time and will be depressed slightly. As the needle loop passes the 6:00 position and becomes slack, the check spring winks back to its relaxed position. This is the time in the cycle that the most thread is being used to form the stitch.

Figure 11C:
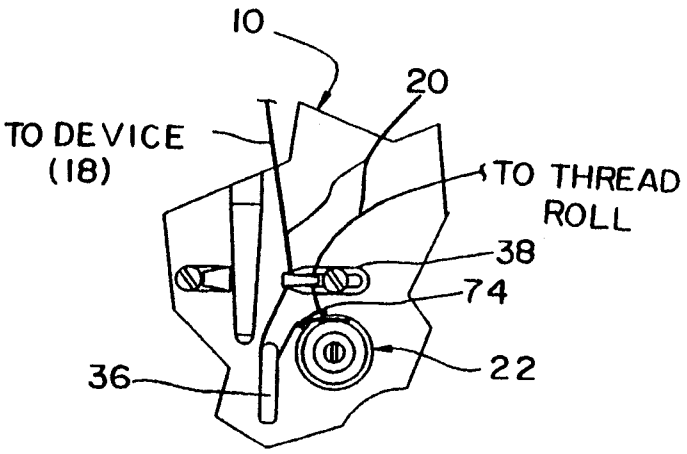
Figure 11B:
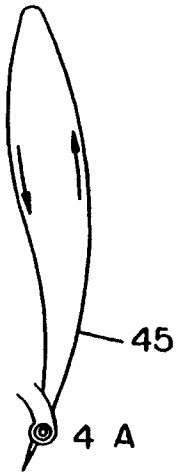
Figure 11A:
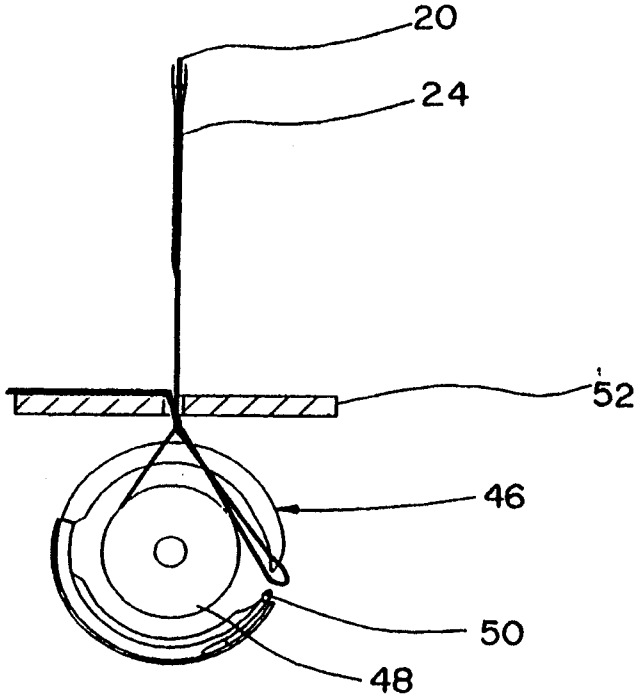

In FIGS. 11*a*, 11*b*, and 11*c*, the hook point 50 is at the 4:00 position. The needle is still rising. The take-up eyelet is at 4:00, a position in relation to the hook point. Actually, at this point, the take-up begins to rise rapidly. This action is necessary in order to keep the needle loop ahead of the hook point 50 later in the sewing cycle. The check spring which held tension on the thread momentarily has winked and returned to its relaxed position.

Figure 12C:
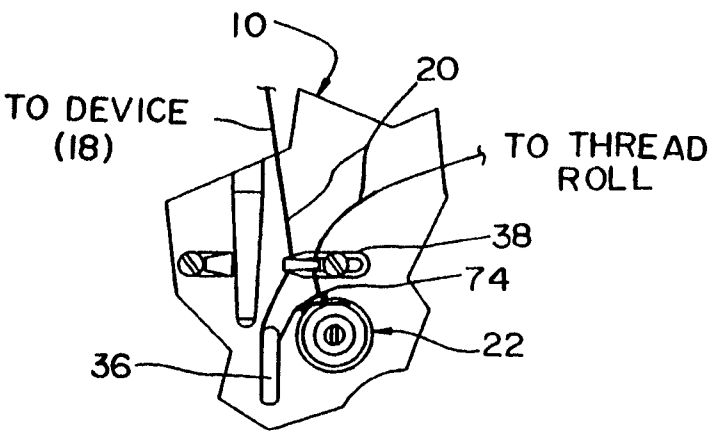
Figure 12B:
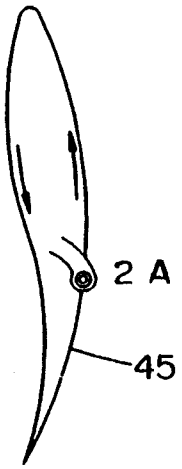
Figure 12A:
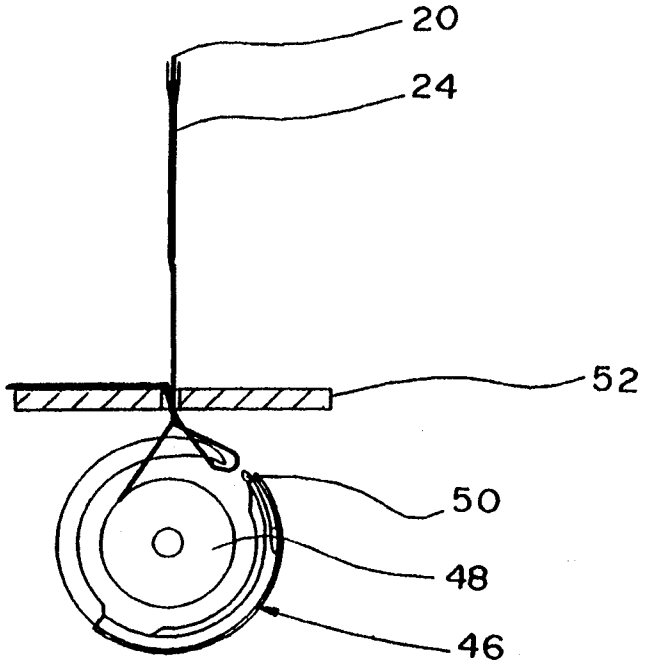

In FIGS. 12*a*, 12*b*, and 12*c*, the hook point 50 is now at the 2:00 position. The needle is still rising. The take-up is at the 2:00A position. It is rising rapidly and drawing the needle loop back up through the throat plate, material, and the eye of the needle. This decreases the size of the needle loop still engaged in the hook assembly. The check spring (FIG. 12*c*) again is just ready to engage the needle thread as the take-up removes the slack.

In FIGS. 13*a*, 13*b*, and 13*c*, the hook point 50 has reached the 12:30 position. The size of the needle loop has greatly decreased because of the rapid acceleration of the take-up. In other words, there is very little needle loop left beneath the material at this point. The needle has reached the top of its stroke. The take-up is rising rapidly at 12:30A. The check spring is depressed by the holding action of the hook assembly 46 on the needle loop. The output of the thread sensor 26 is LOW. The sensing medium arc 14 on the hand wheel is beginning its arc or rotation under synchronizing sensor 16, causing it to go LOW.

Figure 14C:
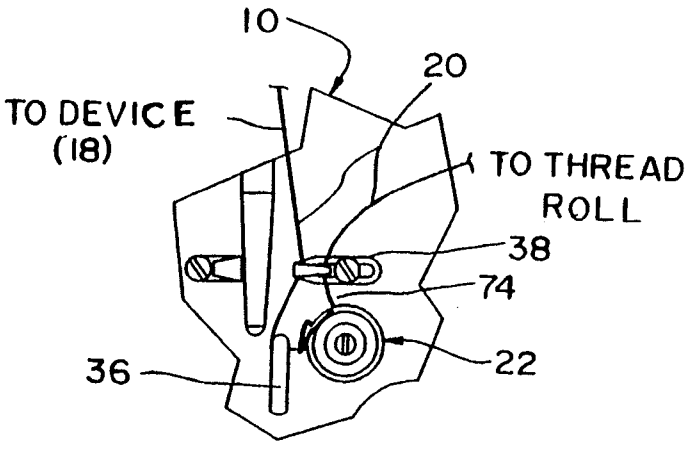
Figure 14B:
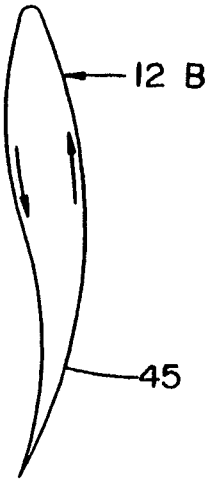
Figure 14A:
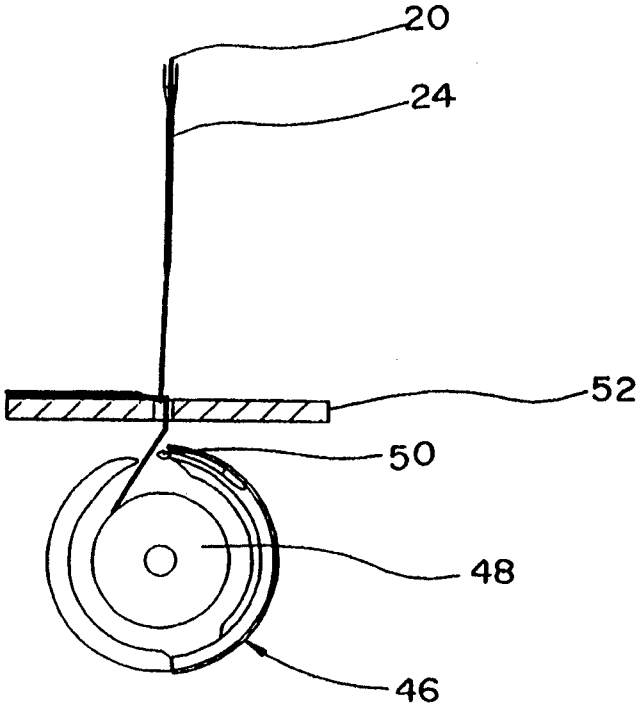

In FIGS. 14*a*, 14*b*, and 14*c*, the hook point is at the 12:00 position, and the stitch is about to be set. The hook assembly will not handle any thread during the revolution about to begin since this will be the revolution during which the material is fed into stitching position. The needle is descending. The take-up is rising at 12:00B. Its action at this point is starting to tighten the stitch in the material against the action of the feed. The check spring has been partly depressed by the action of the take-up on the needle thread.

Figure 15C:
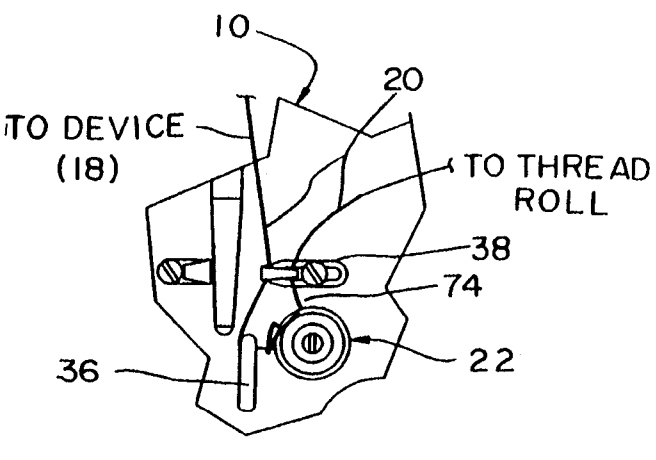
Figure 15B:
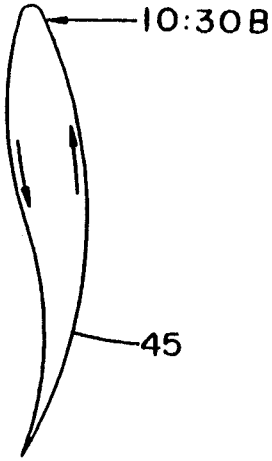
Figure 15A:
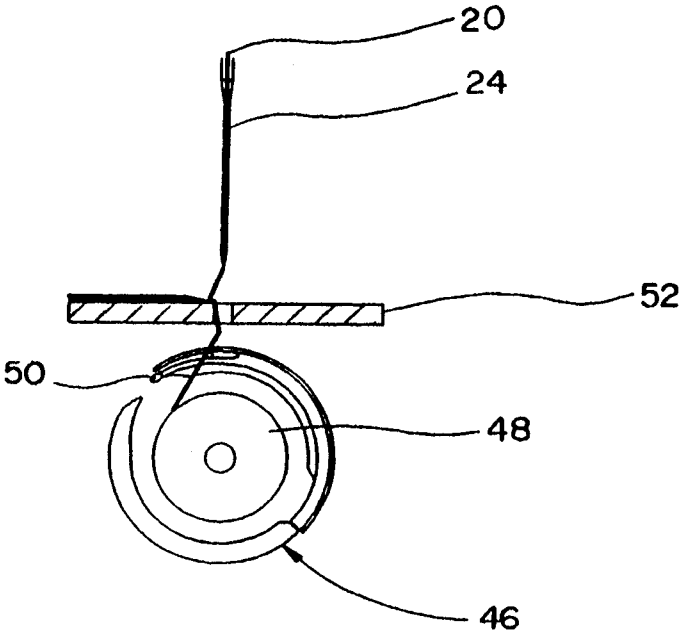

In FIGS. 15*a*, 15*b*, and 15*c*, the hook point 50 is now at the 10:30 position in the feeding revolution. As previously indicated, the hook is not carrying any thread. The needle is descending. The take-up is rising at 10:30 and is now ready to draw needle thread for the next stitch. Drawing of the needle thread occurs at this time because the previous needle loop has pulled up tight in the material around the bobbin thread. About this time, the take-up begins to exert a pull on the needle thread which is greater than the resistance of the needle thread tension adjustment. As a result, a supply of needle thread to replace the thread used in the last stitch is being drawn from the needle thread cone. All of the thread required will be drawn by the time the take-up reaches the top of its travel. The check spring is fully depressed and will remain depressed until all of the needle thread is drawn for the next stitch. At this point, rotation of the hand wheel moves sensing medium 14 from under sensor 16, causing sensor 16 to develop a LOW.

Figure 3:
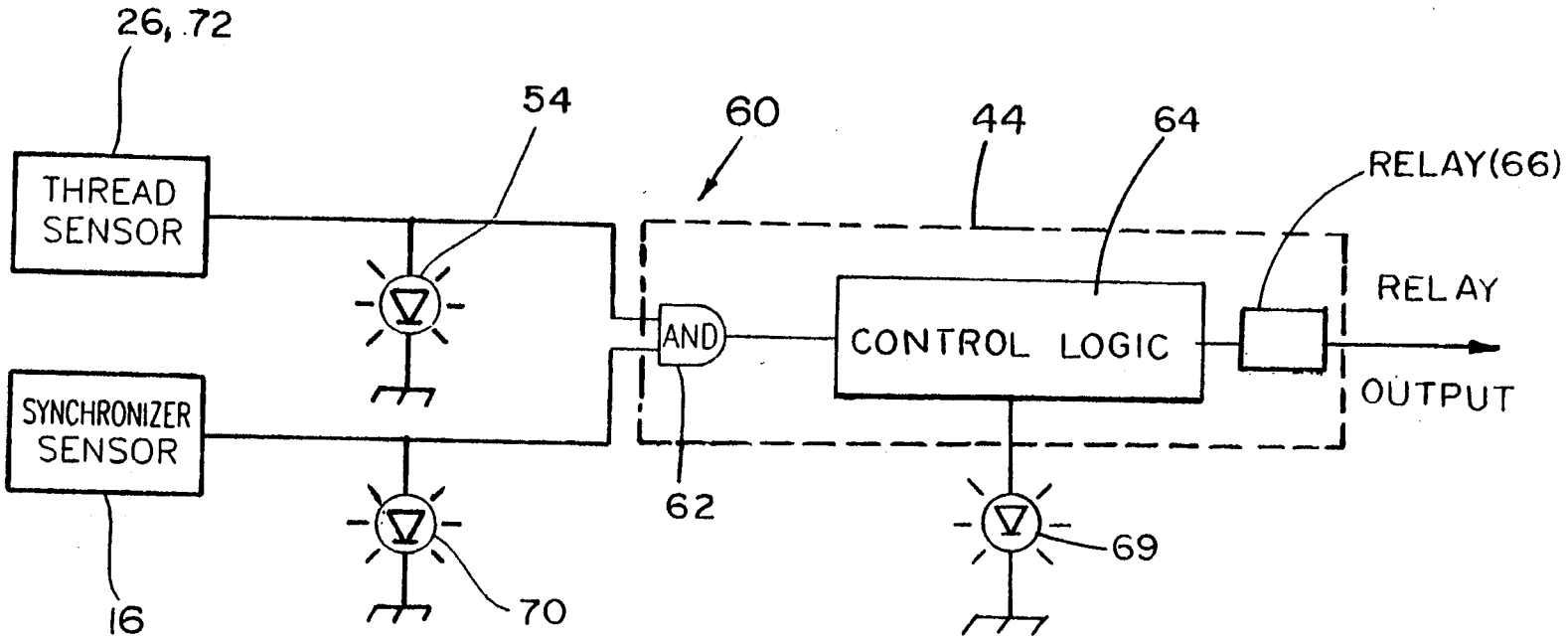
FIG. 3 is a block diagram of the electronic control circuit used in the device of the present invention.

Referring now to FIG. 3, there is illustrated a block diagram of a control circuit 60 which provides proper control of machine 10 to assure that proper stitch formation is achieved during machine operation. The circuit also provides for indicating when proper stitch formation does not occur. Control circuit 60 includes an AND gate 62 and a control logic circuit 64.

As seen in FIG. 3, thread sensor 26 and synchronizer sensor 16 is electrically connected to the AND gate 62 which is connected to control logic circuit 64 having a relay output 66. When high-speed synchronizer sensor 16 output is HIGH and high-speed thread sensor 26 output is LOW at the appropriate time during the stitch formation cycle, a signal is not sent to circuit 64, the circuit 64 does not provide a relay output 66. This condition indicates the presence of a good stitch.

Referring again to FIG. 3, when the position of thread 20 is outside the sensing range of the thread sensor, a needle thread stitch is not being properly formed. This "bad thread position" generates a HIGH signal output from high-speed thread sensor 26 at the appropriate time with the HIGH signal from high-speed synchronization sensor 16 to the AND gate 62, which causes circuit 64 to activate relay output circuit 66. Logic circuit 64 may be provided with an off delay which may be used to hold relay output 66 open for a predetermined period of time, if desired. The condition just described detects an improper stitch formation as a result of a skipped stitch, thread break, absence of needle thread, needle break, and needle thread not picked up and yields an output from the control logic circuit 64 to various other devices capable of stopping the machine, turning on a buzzer, turning on a light, counting improper stitch formation occurrences, and delaying machine operation when improper needle thread stitch formation is detected. Referring again to FIG. 3, LED 54 is a visual signal of activation for high-speed thread sensor 26. LED 70 is a visual signal of activation for high-speed synchronizer sensor 16, and LED 69 is a visual signal of activation for control logic circuit 64.

Figure 4:
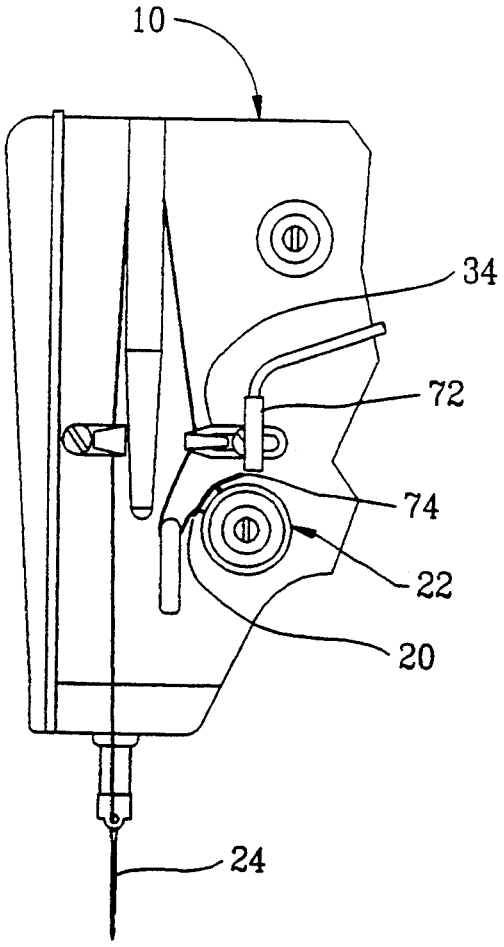
FIG. 4 is a fragmentary front view of a sewing machine having a check spring mounted on the body of the machine. In this embodiment, a high-speed proximity sensor is provided adjacent to the barrel (module arm) of the check spring for detecting changes in the check spring position during machine operation. In this figure, the high-speed proximity sensor is monitoring good check spring position as a result of tension on the thread at the appropriate time in the needle thread stitch formation cycle.
Figure 5:
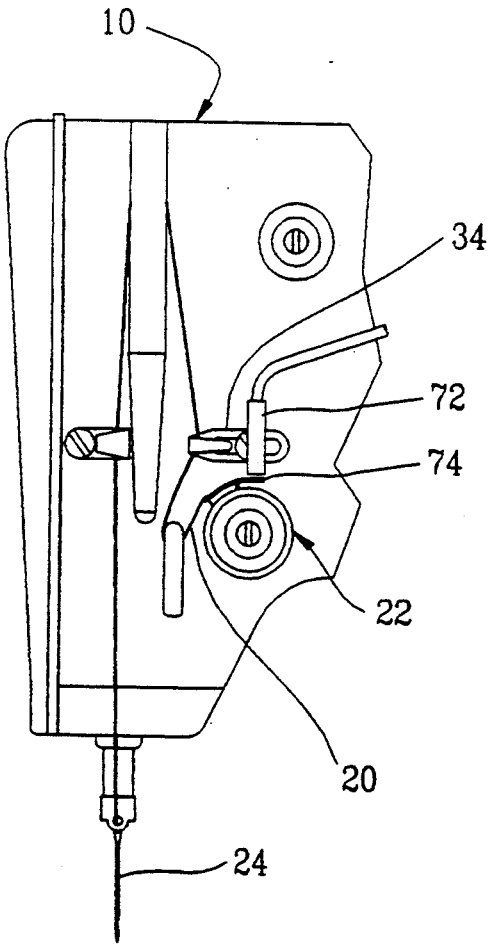
FIG. 5 shows the position of the check spring of FIG. 4 relative to the proximity sensor when bad check spring position occurs as a result of improper tensioning of the thread during the stitch formation cycle.

Referring now to FIG. 4, a high-speed thread sensor is specifically illustrated as a proximity sensor 72 and is mounted on the machine body above check spring assembly 22. The check spring is provided with a pivotally mounted arm 74 which is movable into and out of registry with sensor 72 as a result of thread tension and spring action of the check spring assembly 22. During good thread stitch formation, the thread tension maintains the arm in the position shown in FIG. 4. Bad check spring position (FIG. 5) occurs during improper thread tensioning or no thread tension. This bad check spring position is a result of no tension on the needle thread during the part of the stitch formation cycle when tension should occur. As seen in FIG. 3, the signal from high-speed proximity sensor 72 connects to AND gate 62 in the control circuit 44. The signal sent to AND gate 62 generated by high-speed proximity sensor 72 when bad check spring position occurs during the particular portion of the stitch formation cycle when tension should occur is HIGH and precipitates a relay output from relay output circuit 66. This output is appropriate for use by other control and signaling devices to signal improperly formed needle thread stitch formation for all the foregoing stated reasons.

As stated above, good check spring position (FIG. 4) is being monitored by high-speed proximity sensor 72 as a result of tension on the needle thread during the part of the stitch formation cycle where tension should occur. The signal from high speed proximity sensor 72 detecting good check spring position causes the control circuit to monitor a good stitch.

Figure 2:
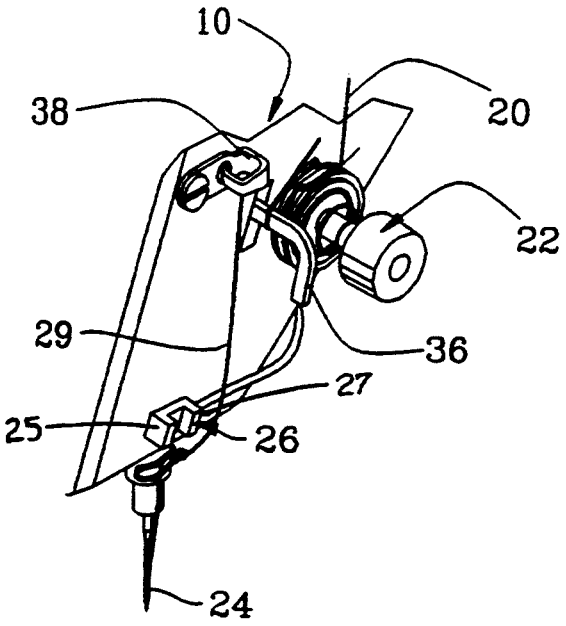
FIG. 2 is an enlarged view of a portion of the sewing machine between the tension device and the needle of FIG. 1 and illustrates the position of the thread at the thread monitoring sensor when bad thread position occurs.

In the embodiment illustrated in FIGS. 1 and 2, a light sensing means is provided to detect good or bad thread position. In this embodiment, sensor 26 is defined by a light-generating and light-sensing assembly 26 which detects the presence or absence of thread passing through the assembly 26. A photo emitter 25 directs a beam of light across a space which is occupied by the thread (if proper tension is being applied to the thread) to a photoreceiver which provides an electrical output indicative of the presence or absence of the thread in the space. Such devices are well known in the art. The light source may be a laser diode, if desired. When proper tension occurs (as in FIG. 1), thread passes through the device and is detected by the light sensor. When improper tension occurs (as in FIG. 2), no thread is detected in the light-generating and light-sensing assembly 26, and appropriate signals are sent to the AND gate in the control circuit as described above.

It is to be understood that in each of the above discussed embodiments of the present invention, the sensing medium on hand wheel 12 covers an arc which permits the sensing medium to be in registry with the high-speed synchronizing sensor 16 for a predetermined period of time. With the hook point at 12:30A, for example, the sensing medium should be approaching top dead center on the hand wheel, and sensing should ideally occur for a distance of 15° rotation of the hand wheel from this point. The sensing can occur all the way through the rotation of the hook point through the 10:30B position. This is up to approximately 30° travel of the hand wheel.

In applying this relationship of the high-speed synchronizer medium sensor 16 and the hand wheel sensing medium 14 to the overall operation of the sensing apparatus, it is first noted that the thread 20 has the appropriate tension as a result of the holding action of the hook assembly on the needle loop. This holding action pulls the thread to good thread position 28 monitored by high-speed thread sensor 26 generating a LOW signal to control box 44 while hand wheel sensing medium 14 is placed in a position to start yielding a signal from sensor 16 immediately after the thread is in good position and continues to yield a signal for 15° of hand wheel travel from that point and not to exceed 30° of hand wheel travel from that point. This generates a HIGH signal to the AND circuit in control box 44.

The foregoing described preferred embodiment discloses apparatus and method for detecting skipped stitches, needle thread breaks, and absence of needle thread at predetermined locations (needle thread not picked up) in specific relation to 301 stitch type machines. While the above description is directed to sewing machines having a single needle, it is to be understood that the principles of the present invention are equally applicable to sewing machines having multiple needles.

It is to be understood that the control unit 44 may be similar to a control unit distributed under the brand name SUNX having Model No. NPS CT7 and distributed by RAMCO Electric Company, 1207 Maple Street, West Des Moines, Iowa. Also, the light sensor 26 (FIG. 2) may be similar to one manufactured under the brand name KEYANCE, Model FS-17.

It is to be further understood that the foregoing description of the preferred embodiment of the invention has been presented for the purposes of illustration and description. It is not intended to be exhaustive or to limit the invention to the precise form disclosed. Many modifications and variations are possible in light of the above teachings. It is intended that the scope of the invention be limited not by this detailed description, but by the claims appended hereto.

I claim:

1. A thread monitoring apparatus for a sewing machine to monitor needle thread feed occurring under the throat plate of a sewing machine to detect skipped stitches including skipped stitches not resulting from broken threads, said sewing machine having operational cycles including a needle thread gathering cycle and a stitch formation cycle including a needle thread loop handling portion, said sewing machine including:

a needle;

thread take-up means mounted on said sewing machine;

a throat plate having a needle thread handling device mounted thereunder;

a source of needle thread disposed for moving in a predetermined path;

a rotatable shaft for imparting synchronous, vertical movement to said needle; and said monitoring apparatus being mounted above and remote from said throat plate and comprising:

indicating means carried by said shaft for rotation therewith, said indicating means disposed for rotation through a predetermined arcuate distance during the stitch formation cycle, said predetermined arcuate distance being the distance said indicating means rotates during said needle thread loop handling portion of said stitch formation portion of said operational cycle wherein said thread is disposed for tensioning between said take-up device and the eye of said needle responsive to said take-up device moving upwardly to tension said thread between said thread loop handling device and said take-up device, detecting means for detecting when said indicating means is rotating through said predetermined distance during said needle thread loop handling portion of said stitch formation cycle and for providing a first electrical signal indicative thereof, thread position sensing means including a thread sensing device secured to said machine above said throat plate, said thread sensing means being disposed for detecting positional changes of said thread at a position adjacent to said thread sensing device when said thread deviates from said predetermined path responsive to said thread loop handling device not forming a proper stitch although needle thread may be present at said thread loop handling portion of said stitch formation cycle, said thread sensing device disposed for providing a second electrical signal in response to said positional changes of said thread adjacent to said thread sensing device and for providing a third electrical signal during travel of said thread in said predetermined path, signal generating means for receiving said first and second and third electrical signals and for generating discrete output signals responsive to reception of said first, second, and third electrical signals, and control circuit means for receiving said discrete output signals for processing thereof, whereby signals indicative of said positional changes of said thread, and therefore indicative of improper thread formation, are outputted therefrom to shut down machine operation or to provide a warning of improper stitch formation.

2. Apparatus as in claim 1 wherein said indicating means is an electrically transmissive element carried on said shaft, and said detecting means includes a member for sensing said indicating means, and control circuit means for providing an electrical output responsive to the sensing of said indicating means by said sensing means.

3. Apparatus as in claim 2 wherein said thread sensing means and said indicator sensing means are electrically connected to said control circuit means for providing said electrical output only if said indicator sensing means and said thread sensing means are active.

4. Apparatus as set forth in claim 3 wherein said electrically transmissive means is a ferrous member which extends in an arc around a portion of said shaft.

5. Apparatus as set forth in claim 4 wherein said control circuit means includes an AND gate.

6. Apparatus as set forth in claim 5 wherein said sewing machine is provided with a check spring assembly thereon between the thread source and said needle, said check spring having a movable element thereon to receive said thread in threaded relation, and said thread sensing means including a proximity switch positioned adjacent to said movable element to monitor movement or non-movement of said arm responsive to proper or improper tensioning of said thread in said arm, said proximity switch disposed for generating said second and third signals to said AND gate of said control circuit means indicative of movement or non-movement of said movable element being caused by proper or improper tensioning of said thread in said movable element.

7. Apparatus as set forth in claim 5 wherein said thread sensing means includes a light generating and sensing assembly, said assembly being mounted above said needle to receive said thread in movable relation therein.

8. Apparatus as set forth in claim 7 wherein said light generating and sensing assembly includes a photoemitter and a photoreceiver disposed in spaced relation, said photoemitter disposed for generating and directing light across said space to said photoreceiver to detect the presence or absence of thread in said space, whereby said second and third electrical signals are generated by said photoreceiver and directed to said AND gate indicative of proper or improper tensioning of said thread in said assembly.

9. Apparatus as set forth in claim 7 wherein said control circuit means includes an AND gate electrically connected to said detecting means and said thread sensing means.

10. Apparatus as in claim 4 wherein said shaft is provided with a hand wheel thereon, and said electrically transmissive ferrous member extends about a 30° arc around a portion of the periphery of said hand wheel and thus around a portion of said shaft.

11. Apparatus as set forth in claim 8 wherein said photoemitter is a laser diode.

12. A thread monitoring apparatus for a sewing machine to monitor looper thread feed occurring under the throat plate of a sewing machine to detect skipped stitches including skipped stitches not resulting from broken threads, said sewing machine having operational cycles including a needle thread gathering cycle and a stitch formation cycle including a needle thread loop handling portion, said sewing machine including:

a needle;

thread take-up means mounted on said sewing machine;

a throat plate having a needle thread handling device mounted thereunder;

a source of needle thread disposed for moving in a predetermined path;

a rotatable shaft for imparting synchronous, vertical movement to said needle; and said monitoring apparatus being mounted above and remote from said throat plate and comprising:

indicating means carried by said shaft for rotation therewith, said indicating means disposed for rotation through a predetermined arcuate distance during the stitch formation cycle, said predetermined arcuate distance being the distance said indicating means rotates during said needle thread loop handling portion of said stitch formation portion of said operational cycle wherein said thread is disposed for tensioning between said take-up device and the eye of said needle responsive to said take-up device moving upwardly to tension said thread between said needle thread loop handling device and said take-up device, detecting means for detecting when said indicating means is rotating through said predetermined distance during said needle thread loop handling portion of said stitch formation cycle and for providing a first electrical signal indicative thereof, thread position sensing means including a thread sensing device secured to said machine above said throat plate, said thread sensing means being disposed for detecting positional changes of said thread at a position adjacent to said thread sensing device when said thread deviates from said predetermined path responsive to said thread loop handling device not forming a proper stitch although needle thread may be present at said thread loop handling portion of said stitch formation cycle, said thread sensing device disposed for providing a second electrical signal in response to said positional changes of said thread adjacent to said thread sensing device and for providing a third electrical signal during travel of said thread in said predetermined path, said thread sensing device comprising a housing enclosing a thread receiving channel and said thread sensing device, said thread sensing device disposed for detecting the presence of needle thread in said predetermined path in said channel and for providing a second electrical signal indicative thereof, said thread sensing device being disposed for detecting if said needle thread deviates from said predetermined path in said channel and from registry with said thread sensing device and for providing a third electrical signal indicative thereof, AND gate circuit means responsive to said detecting means for generating a first HIGH signal when said detecting means is sensing said indicating means, said AND gate circuit means being further responsive to said thread position sensing means for generating a second HIGH signal when said thread is not in registry with said thread position sensing means, and control circuit means for receiving said HIGH signals and to provide an output signal responsive to reception of said HIGH signals for shutdown of said machine or to provide a warning of improper stitch formation.

13. A thread monitoring apparatus for a sewing machine to monitor needle thread feed occurring under the throat plate of a sewing machine to detect skipped stitches including skipped stitches not resulting from broken threads, said sewing machine having operational cycles including a needle thread gathering cycle and a stitch formation cycle including a needle thread loop handing portion, said sewing machine including:

a needle;

thread take-up means mounted on said sewing machine;

a throat plate having a looper mounted thereunder;

a source of needle thread disposed for moving in a predetermined path through said eyelet means of said thread take-up means and said needle;

a rotatable shaft for imparting synchronous, vertical movement to said needle; and said monitoring apparatus being mounted above and remote from said throat plate and comprising:

indicating means carried by said shaft for rotation therewith, said indicating means disposed for rotation through a predetermined arcuate distance during the stitch formation cycle, said predetermined arcuate distance being the distance said indicating means rotates during said needle thread loop handling portion of said stitch formation portion of said operational cycle wherein said thread is disposed for tensioning between said take-up device and the eye of said needle responsive to said take-up device moving upwardly to tension said thread between said needle thread loop handling device and said take-up device, detecting means for detecting when said indicating means is rotating through said predetermined distance during said needle thread loop handling portion of said stitch formation cycle and for providing a first electrical signal indicative thereof, thread position sensing means including a thread sensing device secured to said machine above said throat plate, said thread sensing means being disposed for detecting positional changes of said thread at a position adjacent to said thread sensing device when said thread deviates from said predetermined path responsive to said thread loop handling device not forming a proper stitch although needle thread may be present at said thread loop handling portion of said stitch formation cycle, said thread sensing device disposed for providing a second electrical signal in response to said positional changes of said thread adjacent to said thread sensing device and for providing a third electrical signal during travel of said thread in said predetermined path, said thread position sensing means comprising a check spring assembly having a pivoted arm provided with an eyelet through which said thread is threaded for movement in said predetermined path, said pivoted arm disposed for positioning in a first position responsive to said thread passing through said eyelet in said predetermined path, said pivoted arm disposed for displacement to a second position responsive to said thread deviating from said predetermined path, and a proximity sensor disposed adjacent to said check spring assembly to sense when said pivoted arm is in said first position, which is in registry with said proximity sensor, and for providing a second electrical signal indicative thereof, said proximity sensor disposed for sensing when said pivoted arm is in said second position, which is out of registry with said proximity sensor, and for providing a third electrical signal indicative thereof, signal generating means for receiving said first, second, and third electrical signals and for generating discrete output signals responsive to reception of said first, second, and third electrical signals, and control circuit means for receiving said discrete output signals for processing thereof, whereby signals indicative of displacement of said arm between said first and second positions caused by said positional changes of said thread from said predetermined path, and therefore indicative of improper thread formation, are outputted therefrom to shut down machine operation or to provide a warning of improper stitch formation.

* * * * *